United States Patent [19]

Schlicht et al.

[11] Patent Number: 4,512,903

[45] Date of Patent: Apr. 23, 1985

[54] LUBRICANT COMPOSITIONS CONTAINING AMIDES OF HYDROXY-SUBSTITUTED ALIPHATIC ACIDS AND FATTY AMINES

[75] Inventors: Raymond C. Schlicht, Fishkill; Anthony P. Skrobul, Beacon, both of N.Y.

[73] Assignee: Texaco Inc., White Plains, N.Y.

[21] Appl. No.: 507,270

[22] Filed: Jun. 23, 1983

[51] Int. Cl.[3] ..... C10M 1/32

[52] U.S. Cl. ..... 252/51.5 A

[58] Field of Search ..... 252/51.5 A; 564/201, 564/170, 177, 176

[56] References Cited

U.S. PATENT DOCUMENTS

| | | | |
|---|---|---|---|
| 2,490,756 | 12/1949 | Kenyon et al. | 564/201 |
| 2,848,418 | 8/1958 | Müller et al. | 252/51.5 A |
| 2,898,301 | 8/1959 | Mayhew et al. | 252/51.5 A |
| 2,958,665 | 11/1960 | Stefcik et al. | 252/51.5 A X |
| 3,062,631 | 11/1962 | Thompson | 252/51.5 A X |
| 3,125,530 | 3/1964 | Mayhew et al. | 252/51.5 A |
| 4,334,073 | 6/1982 | Diehr | 564/201 X |
| 4,446,038 | 5/1984 | Schlicht et al. | 252/51.5 A |

*Primary Examiner*—Andrew Metz

*Attorney, Agent, or Firm*—Robert A. Kulason; Robert Knox, Jr.; James J. O'Loughlin

[57] ABSTRACT

Amides prepared from mono- or poly hydroxy-substituted aliphatic monocarboxylic acids and primary or secondary amines which are useful as friction reducing agents.

6 Claims, No Drawings

LUBRICANT COMPOSITIONS CONTAINING AMIDES OF HYDROXY-SUBSTITUTED ALIPHATIC ACIDS AND FATTY AMINES

BACKGROUND OF THE INVENTION

1. Field of the Invention

This invention relates to amides of fatty amines bearing one or more free hydroxyl groups on the acid moiety, their preparation, and uses thereof.

2. Patent Disclosures

U.S. Pat. No. 2,898,301 discloses the preparation of an alkylhydroxy amide from a lactone and an amine. U.S. Pat. No. 2,848,418 claims an alkylarylhydroxy amide prepared from an aromatic ortho-hydroxycarboxylic acid and an alkylamine. U.S. Pat. No. 2,622,067 discloses the reaction of a hydroxycarboxylic acid and a polyalkylenepolyamine.

U.S. Pat. No. 4,237,022 discloses tartarimides of tartaric acid and primary amines. U.S. Pat. No. 2,811,429 describes amine salts of hydroxy aliphatic polycarboxylic acids prepared by mixing an excess of amine with the acid.

SUMMARY OF THE INVENTION

The present invention provides a composition of matter comprising one or more amides represented by the formula:

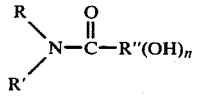

wherein R is a saturated or unsaturated aliphatic based hydrocarbyl radical of about 10 to about 30 carbon atoms; R′ is hydrogen, R or an alkyl group having about 1 to about 30 carbon atoms in a chain which can be straight or branched; R″ is a divalent hydrocarbyl radical including alkylene, alkenylene or alkynylene having 1 to 10 carbon atoms; and n is an integer ranging from 1 to 10 such that only about 1 free hydroxyl radical is attached per carbon atom of the hydrocarbyl radical R″.

Preferred substituents are those where R is an alkyl radical having from 10 to 20 carbon atoms; R′ is hydrogen or an alkyl group having 12 to 18 carbon atoms; R″ is an alkylene group having 1 to 3 carbon atoms and n is 1 to 3. The products are solids, semi-solids or liquids depending on the nature of the starting products. They are soluble and/or stably dispersible in hydrocarbons to the extent necessary to fulfill their intended purpose.

The invention also provides oleaginous compositions comprising a major proportion of a fuel or lubricant and a minor, friction-reducing amount of the above-defined amides or about 0.001 to 5.0 weight percent of the total composition.

DISCLOSURE OF PREFERRED MODE

The present compositions are prepared economically and readily by the following reaction sequence:

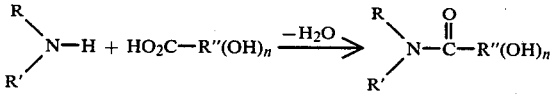

where R, R′, R″, and n are as above.

Alternative reactants are derivatives of the hydroxyacid, such as esters, lactones, amides, and acid halides or anhydrides. In the latter two cases, the hydroxyl group(s) must be blocked with a function unreactive with acids or amines such as arylether which may be removed later by hydrogenation. Also, di, tri or polyamines bearing at least one n-alkyl group, R, as defined above may be employed as reactants to prepared amides having at least one hydroxyacyl substituent where one or more of the amino functions must be converted to a hydroxy acid amide.

Primary amines suitably preferred for the present invention are those wherein R represents an alkyl radical of about 10 to 30 carbons, and preferably from 8 to 18 carbon atoms. Representative amines are those known as aliphatic fatty primary amines and commercially known as ARMEEN primary amines (products produced by Armak Chemical Co., Chicago, Ill.). Typical fatty amines include alkyl amines such as n-hexylamine (caproylamine), N-octylamine (caprylylamine), N-decylamine (caprylamine), n-dodecylamine (laurylamine), n-hexadecylamine (palmitylamine), margarylamine, n-octadecylamine (stearylamine).

Primary amines in which the hydrocarbon chain comprises olefinic unsaturation are also useful. Thus, the R hydrocarbyl radical contains one or more olefinic unsaturation depending on the length of the chain, usually one double bond per 10 carbon atoms. The hydrocarbyl radical contains up to 30 carbon atoms and preferably from 12 to 18 carbon atoms. Representative amines are dodecenylamine, myristoleylamine, palmitoleylamine, oleylamine, and linoleylamine. Such unsaturated amines are also available under the ARMEEN name.

Also suitable are mixed fatty amines such as Armak's Armeen-C, Armeen-O, Armeen-OL, Armeen-T, Armeen-HT, Armeen S and Armeen SD. Secondary amines include dialkylamines having two of the above alkyl groups including such commercial fatty secondary amines as Armeen 2C and Armeen HT, and also mixed dialkylamines where R=a fatty amine and R′ may be a lower alkyl group (1–9 carbon atoms) such as methyl, ethyl, n-propyl, i-propyl, butyl, etc., or R′ may be an alkyl group bearing other non-reactive or polar substituents (CN, alkyl, carbalkoxy, amide, ether, thioether, halo, sulfoxide, sulfone) such that the essentially hydrocarbon character of the radical is not destroyed. The fatty polyamine diamines include mono- or dialkyl, symmetrical or asymmetrical ethylene diamines, propane diamines (1,2, or 1,3), and polyamine analogs of the above. Suitable commercial fatty diamines are "Duomeen C" (N-coco-1,3-diaminopropane), "Duomeen S" (N-soya-1,3-diaminopropane), "Duomeen T" (N-tallow-1,3-diaminopropane), or "Duomeen O" (N-oleyl-1,3-diaminopropane). "Duomeens" are commercially available diamines described in Product Data Bulletin No. 7-10R1 of Armak Chemical Co. 300 S. Wacker Dr., Chicago, Ill. 60606

Suitable hydroxy-substituted monocarboxylic acids include glycolic acid, lactic acid, hydracrylic acid, gamma-hydroxy butyric acid and 2,2-bis-$(HOCH_2)_2$propionic acid. Lactones such as beta-propiolactone, gammabutyrolactones and esters such as methyl or ethyl glycolates, lactates, etc. may be used in place of the acids to prepared the desired amides.

In conducting the preparation of the present compounds, various hydrocarbons, as well as other solvents which are also essentially inert toward amines, acids, or amides, can be used as reaction solvents. Alternatively, no solvent at all may be used, or a diluent oil (mineral or synthetic) may be used as the reaction medium and subsequently be retained in the product for convenience of handling. The reaction may be carried out at atmospheric, superatmospheric, or subatmospheric pressure at temperature ranging from room temperature to about 300° C., but preferably, the reaction is carried out at atmospheric pressure and at 60°–180° C. until water evolution ceases.

Several examples prepared by the methods illustrated in Examples I and II, below, are listed on Table I. The various examples employed minor variations in quantity of solvent, reaction time, and temperature.

EXAMPLE I

This example shows the preparation of the glycolic acid amide of oleyl amine (Armeen O).

A 19.0 g. (0.25 mole) quantity of glycolic acid and 150 ml. xylene are combined in a flask, and 68.5 g. (0.25 mole) commercial oleylamine (Armeen O)is added with stirring. Another 50 ml. xylene is used to wash in all of the amine. The mixture is then heated under an inert ($N_2$) atmosphere to reflux temperature, removing the water by azeotropic distillation into a Dean-Stark trap. When the reaction appears complete (5.1 ml. water collected over about 5 hrs. at 127°–140°), the mixture is cooled and filtered, the the filtrate is distilled at 10 mm Hg pressure to 120° to remove the solvent. The yield was 81.6 g An IR spectrum indicated the presence of amide and hydroxyl groups.

EXAMPLE II

This example shows the preparation of the glycolic acid amide of oleylamine (Armeen OL) by reverse addition (vs Example I) of reactants using an aqueous solution of glycolic acid.

An aqueous (75%) solution (50.00 g 0.5 mole) of glycolic acid is added with stirring to a solution of 132.2 g (0.5 mole) commercial oleylamine (Armeen OL) in 500 ml. xylene. The mixture is heated to reflux under $N_2$ (as in Example II) collecting 14.0 ml. water over 8 hrs. at 130°–138°. Work-up as in Example I provided 160.5 g. of product.

The preparative details and analytical results for all of the examples are given in Table I.

TABLE I

Preparation of Hydroxyacid Amides of Fatty Amines[1]

| Ex. No. | Procedure of Ex. No. | Amine Name | Amine Major component | Amine Wt, g. | Amine Moles | Acid Name | Acid wt, g | Acid Moles | Yield g | Analyses % Nitrogen Found | Analyses % Nitrogen Calc | Analyses Resid. TAN |
|---|---|---|---|---|---|---|---|---|---|---|---|---|
| I | I | Armeen O | Oleyl-$NH_2$ | 68.5 | 0.25 | Glycolic | 19.0 | 0.25 | 81.6 | 4.24 | 4.22 | 7.2 |
| II | II | Armeen OL | Oleyl-$NH_2$ | 132.2 | 0.50 | Glycolic | 50.0[a] | 0.50 | 160.5 | 4.16 | 4.35 | 9.1 |
| III | II | Armeen 2C | $(n\text{-}C_{12}H_{25})_2NH$ | 205.0 | 0.50 | Glycolic | 50.0[a] | 0.50 | 232.5 | 3.20 | 2.78 | 3.3 |
| IV | II | Armeen OL | Oleyl-$NH_2$ | 132 | 0.50 | Lactic | 56.3[b] | 0.50 | 155.0 | 4.23 | 4.17 | 1.92 |
| V | II | Dodecylamine | $n\text{-}C_{12}H_{25}NH_2$ | 92.7 | 0.50 | Lactic | 56.3[b] | 0.50 | 120.0 | 5.37 | 5.44 | 5.28 |
| VI | II | Tetradecylamine | $n\text{-}C_{14}H_{29}NH_2$ | 118.6 | 0.50 | Lactic | 56.3[b] | 0.50 | 159.0 | 4.70 | 4.91 | 0.62 |
| VII | II | Armeen 2C | $(n\text{-}C_{12}H_{25})_2NH$ | 189 | 0.50 | Lactic | 56.3[b] | 0.50 | 234.0 | 2.98 | 3.11 | 1.82 |
| VIII | II | Armeen 2S | $(n\text{-}C_{18}H_{37})_2NH$ | 265.5 | 0.50 | Lactic | 56.3[b] | 0.50 | 313.0 | 2.13 | 2.32 | 1.58 |
| IX | II | Armeen 16D | $n\text{-}C_{16}H_{33}NH_2$ | 49.5 | 0.20 | Lactic | 22.5[b] | 0.20 | 50.0 | 4.12 | 4.38 | 1.09 |
| X | II | Armeen 18D | $n\text{-}C_{18}H_{37}NH_2$ | 54.9 | 0.20 | Lactic | 22.5[b] | 0.20 | 65.0 | 4.04 | 4.04 | 0.51 |
| XI | II | Dodecylamine | $n\text{-}C_{12}H_{25}NH_2$ | 37.1 | 0.20 | Mandelic | 30.4 | 0.20 | 58.0 | 4.34 | 4.38 | 13.67 |
| XII | II | Tetradecylamine | $n\text{-}C_{14}H_{29}NH_2$ | 42.7 | 0.18 | Mandelic | 27.4 | 0.18 | 62.0 | 4.20 | 4.03 | 1.29 |
| XIII | II | Armeen 16D | $n\text{-}C_{16}H_{33}NH_2$ | 37.1 | 0.15 | Mandelic | 22.8 | 0.15 | 46.0 | 3.66 | 3.67 | 1.92 |
| XIV | II | Armeen 18D | $n\text{-}C_{18}H_{37}NH_2$ | 54.9 | 0.20 | Mandelic | 30.4 | 0.20 | 80.0 | 3.43 | 3.43 | 5.32 |
| XV | II | Armeen OL | Oleyl-$NH_2$ | 52.8 | 0.20 | Mandelic | 30.4 | 0.20 | 62.0 | 3.37 | 3.52 | 3.60 |
| XVI | II | Armeen 2C | $(n\text{-}C_{12}H_{25})_2NH$ | 56.7 | 0.15 | Mandelic | 22.8 | 0.15 | 72.0 | 2.78 | 2.74 | 9.62 |
| XVII | I | Armeen OL | Oleyl-$NH_2$ | 66.0 | 0.25 | Propionic[c] | 33.5 | 0.25 | 91.0 | 3.55 | 3.69 | 24.00 |
| XVIII | I | Armeen OL | Oleyl-$NH_2$ | 52.8 | 0.20 | Propionic | 14.8 | 0.20 | 60.0 | 4.39 | 4.38 | 2.22 |

[1]All of these preparations employed xylene as reaction solvent.
[a]An aqueous, approximately 70% (wt), glycolic acid solution was used.
[b]An aqueous solution (approx. 80%, wt) of lactic acid was used.
[c]2.2 Bis-(hydroxy-methyl)-propionic acid.

To demonstrate the utility of the subject class of compounds as friction reducing agents in lubricants, the preparations listed in Table II were blended at 0.5–1% (by weight) into a commercial SAE 10W-40 motor oil which contained the following conventional additives:

SAE 10W-40 Motor Oil Composition

| ADDITIVE | CONCENTRATION, % wt |
|---|---|
| Alkenysuccinimide dispersant | 0.08 N |
| Overbased calcium sulfonate | 0.23 Ca |
| Polyethoxylated alkylphenol | 0.15 |
| Zinc dialkyldithiophosphate | 0.15 Zn |
| Diarylamine | 0.25 |
| Oil concentrate of a polymethacrylate | 0.10 |
| Oil concentrate of an olefin copolymer | 11.70 |
| Silicone antifoamant | 150 ppm |

The oils containing the subject additives were then tested in the Small Engine Friction Test (SEFT) which measures the relative anti-frictional effects of oils and is described in detail in coassigned U.S. Pat. No. 4,275,418 issued Mar. 1, 1983. In this work, the reference oil (A) is the above conventional motor oil formulation to which no friction modifier has been added. The results given in Table II show that the subject compositions, in general, were very effective friction-reducing agents at very low concentrations. It may be seen that both mono-hydroxy and di-hydroxy carboxylic acids provided effective amides; the amides of glycolic, lactic, and 2,2-bis-hydroxymethyl propionic acid being particularly effective as shown by the decrease (−) in the oil's coefficient of friction. In particular, while the amide of propionic acid (an acid containing no free hydroxy groups as required by this invention) and oleyl amine (Ex. XVIII) did not affect the friction between the amide of oleyl amine and 2,2-bis-hydroxymethyl propionic acid (Ex. XVII) reduced friction by 7.7%.

TABLE II

| Friction Tests on Oil Blends Containing The Subject Compositions | | | |
|---|---|---|---|
| | Friction Modifier[1] | | Small Engine Friction Test |
| Oil | Ex. No. | Wt. % | (Friction, %)[2] |
| A | None | | 0 ± 3 |
| B | I | 1.0 | −14 |
| C | II | 0.5 | −18 |
| D | III | 0.5 | −5.5 |
| E | IV | 0.5 | −9.2 |
| F | V | 0.5 | −7.8 |
| G | XIV | 0.5 | −1.0 |
| H | XV | 0.5 | 0 |
| I | XVI | 0.5 | 0.68 |
| J | XVII | 0.5 | −7.7 |
| K | XVIII | 0.5 | 0 |

[1]The friction modifiers were blended into the oil at the dosages shown.
[2]As measured in wt. % by the torque exerted on motoring the engine at 280° where boundary lubrication prevails. The results on the test oils are compared to the average of six runs on the reference oil.

Contrarily, the amides of mandelic acid (an aromatic hydroxy acid $C_6H_5CH(OH)COOH$) provided essentially no friction modifying capability as measured in the SEFT. Presumably steric hindrance is preventing the hydroxyl group in the molecule from interacting with the metal surfaces in the SEFT engine and yielding a reduction in motoring torque.

Also performed were experiments designed to demonstrate the criticality of the hydroxyl group in these molecules on their friction reducing properties. The amide of propionic acid and Armeen OL (a molecule analogous to the lactamide of Armeen OL but lacking a hydroxyl group) showed no activity in the SEFT (Table II, Oil K). Similarly, when the hydroxyl group of N-oleyllactamide (Table I, Ex. no. IV) was acetylated with acetic anhydride, the resulting product (an ester-amide) was also inactive in the SEFT. These control experiments emphasize the effect of the presence of a hydroxyl group in the acid moiety on the friction reducing properties of an amide of a fatty amine.

In addition to motor oil formulations, the subject compositions are useful in formulating such diverse products as diesel engine oils, automatic transmission fluid, turbine oils, aircraft and jet engine oils, outboard motor and other 2-cycle engine oils, gas engine oils, paper machine oils, greases, and fuels (e.g. jet fuels). Thus, the fuel compositions of this invention can contain, in addition to the amides of this invention, other additives which are well known to those skilled in the art. These can include anti-knock agents such as tetraalkyl lead compounds, lead scavengers such as haloalkanes (e.g., ethylene dichloride and ethylene dibromide), deposit preventors or modifiers such as triaryl phosphates, dyes, cetane improvers, antioxidants such as 2,6-di-tertiary-butyl-4-methylphenol, rust inhibitors, such as alkylated succinic acids and anhydrides, bacteriostaic agents, gum inhibitors, metal deactivators, demulsifiers, upper cylinder lubricants, anti-icing agents and the like.

With motor oils, the invention also contemplates the presence of detergents, dispersants, corrosion and oxidation inhibitors, antifoam agents, pour-point depressants; etc. in the usual amounts required to perform their intended funtion in the given oil. Such other lubricant and/or fuel additives form no part of the present invention.

What is claimed is:

1. A lubricant composition comprising a major amount of an oil of lubricating viscosity and a minor effective friction-reducing amount of a reaction product formed by reacting equimolar amounts of an amine represented by the forming RR'NH wherein R is an aliphatic-based hydrocarbyl radical of about 10 to about 30 carbon atoms and R' is hydrogen or an alkyl group having 12 to 18 carbon atoms, with a hydroxy-substituted aliphatic monocarboxylic acid selected from the group consisting of glycolic, lactic, and 2,2 bis-(hydroxymethyl)propionic acid, said reaction being conducted at a temperature ranging from about 60° to 180° C.

2. A lubricant composition according to claim 1 containing from about 0.001 to about 5.0 weight percent of said reaction product.

3. A lubricant composition according to claim 1 in which said reaction product is prepared from oleyl amine and glycolic acid.

4. A lubricant composition according to claim 1 in which said reaction product is prepared from bis-dodecyl amine and glycolic acid.

5. A lubricant composition according to claim 1 in which said reaction product is prepared from oleyl amine and lactic acid.

6. A lubricant composition according to claim 1 in which said reaction product is prepared from oleyl amine and 2,2-bis(hydroxymethyl)propionic acid.

* * * * *